US005255772A

United States Patent [19]

Ball et al.

[11] Patent Number: 5,255,772

[45] Date of Patent: Oct. 26, 1993

[54] HANDRAIL FOR ESCALATORS AND MOVING WALKWAYS WITH IMPROVED DIMENSIONAL STABILITY

[75] Inventors: Ronald H. Ball, Oshawa; A. Stuart Caunce, Scarborough, both of Canada

[73] Assignee: Escalator Handrail Company, Ontario, Canada

[21] Appl. No.: 994,762

[22] Filed: Dec. 22, 1992

[51] Int. Cl.[5] ..... B66B 23/24

[52] U.S. Cl. ..... 198/337

[58] Field of Search ..... 198/335, 337, 821

[56] References Cited

U.S. PATENT DOCUMENTS

| | | | |
|---|---|---|---|
| 1,101,209 | 6/1914 | Pitt . | |
| 1,186,550 | 6/1916 | Cobb . | |
| 2,956,662 | 10/1960 | Hansen . | |
| 3,463,290 | 8/1969 | Tajima | 198/337 |
| 3,623,590 | 11/1971 | Johnson . | |
| 3,778,882 | 12/1973 | Cameron et al. . | |
| 3,949,858 | 4/1976 | Ballocci et al. . | |
| 4,469,729 | 9/1984 | Watanabe et al. | 198/337 |
| 4,776,446 | 10/1988 | Fisher et al. . | |
| 4,852,713 | 8/1989 | Tatai et al. . | |
| 5,160,009 | 11/1992 | Iyoda et al. | 198/337 |

FOREIGN PATENT DOCUMENTS

| | | | |
|---|---|---|---|
| 2000266 | 7/1971 | Fed. Rep. of Germany | 198/337 |
| 2142098 | 8/1973 | Fed. Rep. of Germany | 198/337 |
| 3921887 | 1/1991 | Fed. Rep. of Germany . | |
| 3921888 | 1/1991 | Fed. Rep. of Germany . | |
| 3930351 | 3/1991 | Fed. Rep. of Germany . | |
| 16629 | 5/1977 | Japan . | |

*Primary Examiner*—Joseph E. Valenza

*Attorney, Agent, or Firm*—Bell, Seltzer, Park & Gibson

[57] ABSTRACT

An improved handrail construction is provided. Normal handrail for use on escalators moving walkways and the like have a C-shaped cross-section with a stretch inhibitor extending longitudinally of the handrail to maintain dimensional stability of the handrail during use. Multiple plies of reinforcing fabric are also located in the handrail where both the stretch inhibitor and multiple plies are molded in a rubber composition to provide the completed handrail. The improvement which provides increased lateral stiffness, dimensional stability and greater lip strength, comprises two spaced apart plies of reinforcing woven fabric orientated to have stiff principal yarns extending perpendicular to the stretch inhibitor. The two spaced apart plies are interconnected by a rubber composition which has a higher strength in terms of stiffness, hardness and viscosity than the normal rubber composition used to encase the fabric plies and stretch inhibitors. The two spaced apart plies with the transversely extending principal yarns, as interconnected by the tougher rubber composition, forms a structural sandwich construction to provide the improved structural properties of the handrail.

14 Claims, 3 Drawing Sheets

HANDRAIL FOR ESCALATORS AND MOVING WALKWAYS WITH IMPROVED DIMENSIONAL STABILITY

FIELD OF THE INVENTION

This invention relates to novel construction of a rubber composite handrail for use on escalators, moving walkways and the like and to processes for making the novel composite handrail.

BACKGROUND OF THE INVENTION

Handrails for escalators, moving walkways and the like perform an essential function and serve as a safety component of the system. The handrail must provide a firm grip for the passenger and yet be sufficiently flexible to bend around various drive wheel mechanisms and as well as strong enough to withstand several hundreds of pounds of tensile force. Canadian Patent 898,726 discloses a widely used type of handrail construction having the standard C-shaped cross-section with longitudinally extending stretch inhibitor, body reinforcing fabric plies and slider member joined together in a molded rubber composition. The stretch inhibitor is provided as an integral band of several steel wire cables which are embedded in a rubber body matrix. The wire cables are under tension and are sufficient in number to meet the load specification of approximately 30,000 Newtons tensile strength and without extending under a load of 2230 Newtons by more than 0.1% in length.

As with most handrail constructions, the C-shaped cross-section handgrip is made from compounded synthetic rubber. There are multiple plies of rubber coated fabric provided within the handrail structure. The fabric layers may be positioned on either or both sides of the stretch inhibitor cables as for example, three of the plies lie above the stretch inhibitor cables whereas one of the plies lies underneath. Normally the inner surface layer of the handrail is of closely woven nylon, polyester or cotton fabric to provide minimal frictional contact with the escalator or moving walkway support structure and is commonly referred to as the slider ply. This construction allows sufficient flexibility for the handrail to travel along the escalator walkway system, particularly over the drive portion thereof. The C-shaped cross-section for the handrail is designed such that its inwardly directed lips engage a guide rail where sufficient tolerance is provided to allow easy movement and minimum wear of the slider fabric. However, the tolerance is such to prevent the ingress of fingers and clothing into the space between the moving handrail and the guide to prevent possible injury. To this end, regulatory authorities and manufacturers have set specifications on the inwardly directed lip space dimensions and the lip strength as determined by the handrail's resistance to distortion and the handrail's tendency to open up over its service life by virtue of the inwardly directed lips moving apart. However, it has been difficult for the industry to solve this problem in an economical manner. Most handrails on the market tend to become loose and hence unfit for continued use. As the handrail becomes loose, significant costs are then associated with down time to repair and/or replace the handrail and with potential personal injury liability.

A variety of handrail constructions are described in the patent literature which show various structures and some of which have in one way or another addressed the above problems, however, their solutions tend to be inadequate and therefoe not recommended.

U.S. Pat. No. 1,101,209 discloses a T-shaped handrail construction wherein the body of the handrail comprised several layers of rubber-coated fabric in a continuous band. The requirement for inextensibility and fitment to the rail-guide is met by incorporating three reinforcing ropes along the length of the handrail, i.e. one in the centre of the body and one along each edge of the T section.

U.S. Pat. No. 1,186,550 discloses the incorporation of a braided fabric layer into the coverstock which is close to the surface of the handrail. The locating of the fabric layer redistributes the bending stress and reduced premature cracking of the handrail.

U.S. Pat. No. 2,956,662 describes the use of a continuous U-shaped metal ribbon to give an inextensible handrail with high transverse strength and rigidity. However, in order to obtain flexibility in the longitudinal direction the ribbon needs to be perforated or slit laterally.

U.S. Pat. No. 3,623,590 lexplains that conventional C-shaped handrail tends to lose its resilience at the gripping edges due to the severe reverse bending experienced on some escalators. A flattened C-shape construction is described wherein the edge of the section is very flexible, and thus can endure a long duration of bending in both forward and backward modes.

In order to make a handrail of high lateral stiffness, U.S. Pat. No. 3,778,882 describes an intricate construction and process of injection molding rigid thermoplastic sections over a continuous wire reinforcement and molding over this composite a flexible cover.

U.S. Pat. No. 3,949,858 discloses a construction of a C-shaped handrail which uses three parallel inextensible cords as a stretch inhibitor and a fabric ply incorporated into the body stock near the inner surface to obtain lateral stiffness.

Published Japanese patent application (1977)-16629 discloses a design for C-shaped handrail in terms of the preferred section height, width, thickness, shape, in order to optimize the flexibility and lateral stiffness, particularly for use on escalators with a small diameter drive mechanism and to minimize power consumption.

U.S. Pat. No. 4,776,446 discloses a means of providing lateral stiffness to an extruded elastomeric handrail with continuous ribbon stretch inhibitor. This process involves placing a hard thermoplastic U-shaped liner into the handrail. It is necessary to incorporate slots into the liner in order to have longitudinal flexibility.

In a similar invention, U.S. Pat. No. 4,852,713 discloses a method for molding a polyurethane liner into a steel cord reinforced C-shaped handrail. Again, in order to achieve the required longitudinal flexibility it is necessary to have slots in the liner.

Published German patent applications DE 3,921,887, DE 3,921,888 and DE 3,930,351 disclose the incorporation of molded inserts, the use of low friction polymeric coatings and fire retardant compounds, and particularly, the use of five overlapping fabric layers to obtain sufficient lateral stiffness.

The industry still requires a simple expedient construction and method of manufacture of handrails to increase their lateral stiffness and lip strength while maintaining their longitudinal flexibility.

SUMMARY OF THE INVENTION

This invention provides an improved handrail construction which exhibits increased lateral stiffness, dimensional stability and greater lip strength properties compared to the prior art. The construction is provided in a relatively inexpensive manner and can be readily manufactured to provide for extended long-term service, more reliable operation and safer product.

According to an aspect of the invention, an improved handrail construction adapted for use on escalators, moving walkways and the like and which exhibits increased lateral stiffness, dimensional stability and greater lip strength properties is provided. The components of the handrail construction include:

i) a C-shaped cross-section with a transverse portion and opposing inwardly directed lip portions, the opposing lip portions locating the handrail for use on escalators and moving walkways, ii) a stretch inhibitor extending longitudinally within the handrail through the transverse portion, iii) multiple plies of reinforcing fabric are located in the transverse portion, iv) the stretch inhibitor and multiple plies are molded in a first rubber composition to provide the C-shape cross-section, v) a slider member is provided on the underside of the handrail.

The improvement in the structure of the components of the above handrail construction and which provides the increased lateral stiffness, dimensional stability and greater lip strength properties, comprises:

vi) two spaced apart plies of reinforcing woven fabric having stiff principal yarns which extend perpendicular to the stretch inhibitor and across the transverse portion and around the opposing lip portions to adjacent opposing edges of the opposing lip portions, vii) the two spaced apart plies being interconnected by a second rubber composition which has a higher strength in terms of stiffness, hardness and viscosity than the first rubber composition, viii) the two spaced apart plies with the transversely extending principal yarns and the interconnecting second rubber composition forming a structural sandwich construction which provides the increased properties, ix) the sandwich construction being molded within the first rubber composition to complete the improved handrail construction.

DETAILED DESCRIPTIONS OF THE PREFERRED EMBODIMENTS

Figures 1, 2:
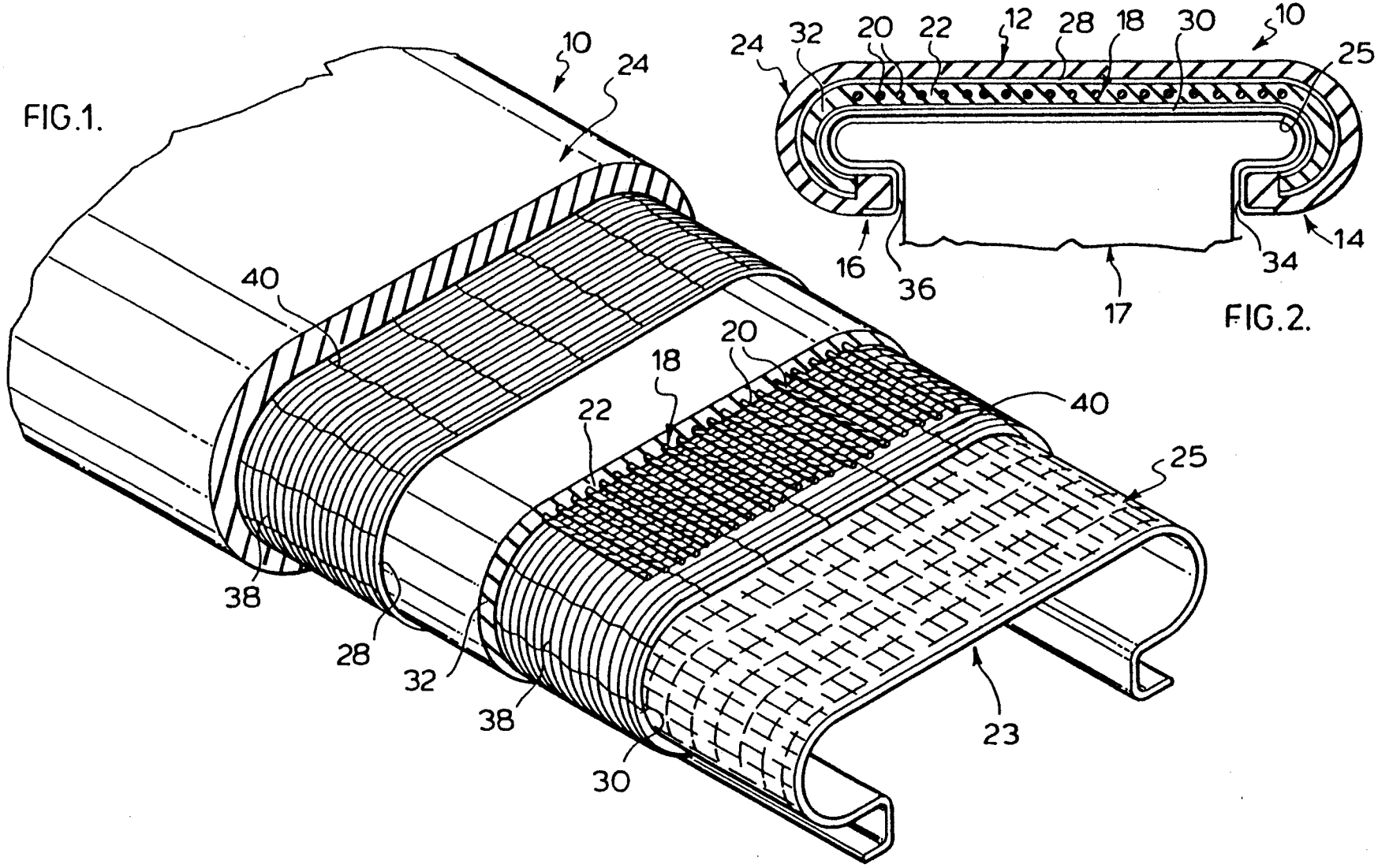
FIG. 1 is a perspective view with sections of the handrail removed in a step-wise manner to show the novel feature of the handrail construction.
FIG. 2 is the cross-section of the handrail of FIG. 1.

A preferred structure for the improved handrail is shown in FIGS. 1 and 2. The handrail 10 has the conventional C-shaped cross-section with a transverse section 12 and opposing inwardly directed lip portions 14 and 16. The opposing lip portions are provided for purposes of locating the handrail for use on a guide 17 or the like provided on escalators or moving walkways A stretch inhibitor 18 is provided and extends longitudinally of the handrail and through the transverse portion 12. The stretch inhibitor 18 comprises a plurality of individual spaced apart cables 20. In accordance with this embodiment the cables are of steel wire. These cables can be pre-encapsulated in a rubber compound matrix 22 by an extrusion or calendering process. It is understood however that the stretch inhibitor may be any of the other standard types of tensile reinforcement members which are located in the handrail structure, for example, any continuous load bearing element, such as, steel strip, ribbons of high tensile strength monofilaments and the like.

In accordance with standard techniques, the handrail has the outer cover stock 24 of the normal rubber composition which is compounded of natural and/or synthetic rubbers. On the underside 23 of the handrail is the usual layer of woven fabric 25 or the like which constitutes the slider portion of the handrail. The slider portion lies on top of the guide provided on the escalator walkway or the like. As already explained, the slider portion is of a fabric or other like material which has a reduced coefficient friction so as to slide freely along the guide of the escalator system.

The improvement in accordance with this invention is the provision of the two spaced apart fabric reinforcement plies 28 and 30 as shown in FIG. 2, which in accordance with this embodiment, extend from opposing lip portion 14 across the transverse section 12 and around to the other opposing lip portion 16. The spaced apart plies of fabric are normally consistently spaced apart throughout the C-shaped section. The spacing is normally in the range of 1 to 3 mm. However, it is understood with certain types of handrail constructions that the spacing may be greater than 3 mm. Normally the wire cable 20 used in the stretch inhibitor 18 has a diameter in the range of 0.5 mm up to possibly 2 mm. It is appreciated that the plies need not necessarily extend all the way through the opposing lip portions to their innermost opposing edges 34 and 36. They usually, however, extend at least around the lip portion and toward the edges 34 and 36, but stop short thereof so as to be adjacent the respective opposing edges.

A further aspect of this improvement is embodied in the form of the provision of a different, stronger type of rubber composition which binds the spaced apart plies 28 and 30 and may as per this embodiment also constitute the wire cable rubber matrix 22. The second rubber composition has a higher strength characteristic in terms of its stiffness, hardness and viscosity than the normal rubber composition used to form the cover stock 24. As will be demonstrated in the following examples and tables the strength characteristics of the second rubber composition is preferably at least 10% greater than that of the first rubber composition used to complete the handrail construction. By virtue of this second rubber composition 32 binding the opposing plies 28 and 30 together, a structural sandwich construction is provided which provides the improved properties for the handrail in the form of increased lateral stiffness, dimensional stability and greater strength.

Another feature of this improved structure as shown in FIG. 1, is that the opposing plies 28 and 30 of woven material each have their stiff principal yarns extending perpendicular to the stretch inhibitor and more particularly, with this embodiment, perpendicular to the cables 20 of the stretch inhibitor. The principal yarns 38 extend across the transverse portion and around the opposing lip portions to adjacent the inner edges 34 and 36. The secondary yarns 40 do not have any significant structural function other than to maintain the character of the fabric during rubber coating thereof. It has been found that by the combination of the spaced apart plies having their principal yarns extend in the transverse direction and being interconnected by the tougher second rubber composition, provides a surprising increase in the desired structural properties of the handrail.

As will be demonstrated in the following examples, the provision of the structural sandwich construction within the handrail provides a very significant increase in the desired structural properties of the handrail without necessitating any exceptional cost of material or cost related to the manufacture thereof. The handrail can be readily manufactured in the same type of sectional compression molding equipment as is used in the manufacture of conventional handrails. The process involves the assembly of the individual functional components, namely, the plies of extruded rubber, calendered fabric, tensile reinforcement members embedded in a rubber matrix and woven fabric slider. As previously discussed the tensile reinforcement member or the stretch inhibitor may be located either between the spaced apart plies 28 and 30 or may be located beneath or above those plies. Depending however on the structure of the stretch inhibitor it is desirable to either place the stretch inhibitor between the plies or beneath the plies adjacent to slider member 26. This prevents excessive working of the rubber material as the handrail passes over the drive wheels and the like of the escalator walkway.

As with normal escalator handrail fabrication the elastomers used in the make-up of the handrail are of the thermosetting type, thereby requiring the application of heat and pressure to shape the product, consolidate the components and cure the elastomer compounds. Strips of the functional elements of appropriate width and thickness for the product size would be plied up in the appropriate order and preformed into a crude handrail shape. For example, the plies 28 and 30 may be spaced apart by an extruded section of rubber 32 of the second composition. The stretch inhibitor matrix 18 may be then placed between the plies 28 and 30 and in this particular embodiment between the extruded rubber 32 and the lower ply 30. The slider 26 is positioned on the underside of the built handrail. The first rubber composition is placed on this built assembly and then shaped and cured under pressure in the mold for the required time and at proper temperature to provide a final integrated product.

It is appreciated that the two spaced apart plies of calendered fabric are normally rubber coated fabric where the rubber coated material is adapted to bond to the rubber of the second composition of layer 32.

As already noted, the fabric of the spaced apart plies has the stiff principal yarns extending perpendicular to the stretch inhibitors. Such fabrics may consist of stiff principal yarns of cotton or stiff principal yarns of glass monofilaments or polyaramid monofilaments. Alternatively, the principal yarns may be of twisted continuous filaments of glass, polyaramid and the like.

In the preferred embodiment of this invention the fabric used is a glass monofilament yarn of 330 denier/3 ply with tensile strength of 700 Newtons and elongation at break of 1.3%. The yarns are pretreated with resorcinol-formaldehyde latex (RFL) which constitutes an adhesion promoter. The yarns are calendered with a natural rubber/styrene-butadiene rubber (SBR) blend compound having about a 60 Shore A hardness. The fabric layers may be calendered to a total thickness of about 1.3 mm each.

The rubber of the second composition is preferably a natural rubber/styrene-butadiene rubber blend which is mixed in accordance with industry standards using hydrocarbon oil to extend the polymer in the mixing equipment. Mixed in with this blend are fine particles of carbon black and powdered clay to increase the strength properties of the second rubber composition where such strength is measured in the form of improved tensile strength modulus and hardness. Resins may also be added to act as tackifiers to facilitate the fabrication process and also to aid in the extrusion and shaping of the intermediate rubber layer 32 of the construction. The rubber is normally vulcanized by sulfur which is activated by zinc oxide and accelerated by the addition of sulphenamide and thiuram salts. In accordance with standard practice, antioxidants, antiozonants and waxes are also added to protect the rubber composition from premature deterioration.

The rubber of the first composition which is used primarily in the coverstock and to in essence complete the construction of the handrail in the form of the body matrix can be a blend of natural rubber and/or synthetic rubbers or all synthetic rubber. That rubber may also be vulcanized by use of sulfur which is activated by zinc oxide and accelerated by the addition of sulphenamide and thiuram salts. As with the second rubber composition, the first rubber composition may also contain antioxidants, antiozonants and waxes for the above recited purposes. In accordance with a preferred embodiment of the invention, the compositions for the first and second rubber compound formulations are set out in the following Table 1.

TABLE 1

| RUBBER COMPOUND FORMULATIONS | | |
|---|---|---|
| Ingredient | First Rubber Composition | Second Rubber Composition |
| SBR | 40–80* | 55–100 |
| BR | 60–20 | — |
| NR | — | 15–0 |
| Carbon Black | 85 | 90–100 |
| Clay | — | 15–20 |
| Extender Oil | 12 | 10–15 |
| Tackifier | 3 | 4 |
| Antioxidant | 0.5 | 1.5 |
| Antiozonant | 1 | 2 |
| Wax | 2 | 1 |
| Process Aid | — | 8 |
| Curatives | 10–15 | 14 |
| PHYSICAL PROPERTIES | | |
| Mooney Viscosity (ML1 + 4), 121.5 C | 60 | 78 |
| Hardness, Shore A | 75 | 84 |
| Modulus, 300%, psi | 1900 | 2300 |
| Tensile strength, psi | 2100 | 2450 |
| Elongation, % | 300 | 330 |
| Tear strength, pli | 180 | 225 |

*parts per hundred of rubber content

For purposes of interpretation of the component symbols used in the above table and as well sources of supply the following information is provided.

Styrene-butadiene rubber (SBR) is of the SBR 1500 cold polymerized type available from several suppliers, e.g., Shell Chemicals Co.

Natural Rubber (NR) is the Standard Malaysian grade, SMR 20.

Polybutadiene Rubber (BR) is of the Taktene 1252 grade supplied by Polysar Corp.

Carbon blacks used are the ASTM grades N-326, N-339 and N-550 available from Cabot Corp. These carbon blacks may be used as a blend where N-339 is a high abrasion (resistant) furnace carbon black with small particle size moderate surface area and high structure. N-326 is high reinforcing, high abrasion low structure furnace carbon black with small particle size and moderate surface area.

The clay is of the hard Dixie type supplied by R. T. Vanderbilt Inc. Dixie Clay is high quality reinforcing light coloured hard clay powder (with average particle size less than 2 microns).

Extender oil is the Sundex type supplied by Sun Oil Co.

The tackifier and the process aids are synthetic coresin types available from Struktol Inc.

The antioxidant can be Naugard Q, or BLE and the antiozonant is Flexzone 7 available from Uniroyal Chemicals Inc.

The curatives masterbatch contains sulphur, zinc oxide, zinc stearate, cyclohexylsulphenamide and tetramethylthiuram disulphide. The proportions can be varied to adjust the rate and state of cure of the rubber compound as required.

As will be demonstrated in the following examples, there is a significant improvement in the lip strength of the handrail construction of this invention. The lip strength of handrails normally available in the marketplace is in the range of 70 to 80 newtons. This lip strength is measured by use of a special tool with a pair of mechanical jaws. The jaws are placed into the opening of the C-section of the handrail and set to grip a 30 mm length on the face of each edge of the opposing inwardly directing lips of the C-section of the handrail The jaws are levered open until the distance between the faces of the C-section are expanded by a distance of 7 mm. The force required for this expansion is then read from a calibrated load cell and recorded as lip strength. With the construction according to this invention the handrail exhibits significant increase in lip strength by as much as 30%, that is in excess of 100 Newtons and normally greater than 105 Newtons.

EXAMPLE 1

Static Testing—Lip Strength

Handrail sections were manufactured to the dimensional specifications for a common commercial handrail using the standard construction materials and technique, and also using the construction of this invention. The standard construction comprises in section the usual slider ply and 3 or more reinforcing plies with the stretch inhibitor cables extending along between two of the adjacent reinforcing plies. This section is bonded together by the usual cured rubber composition.

Sections of both of these handrails were subjected to static testing using a laboratory circular bending jig. This jig is simply a semicircular platform made from rigid materials whereon the handrail can be bent forward, i.e., the open side towards the surface, and backward, i.e, the open side away from the surface. The test method requires that the handrail be fastened at one end to the platform and a load applied to the other end until the handrail completely seats itself on the semicircular platform. The load required to seat the handrail is a measure of its longitudinal stiffness and flexibility.

Test data for bending both forward and backward around a jig of 24 inches diameter are listed in Table 2 for tests on sections of both of the conventional handrail and the subject handrail structure. For both the forward and backward bending test it is observed that it takes considerably less force to bend the subject handrail, which means that it is a more flexible product. This is believed to be due to the fact that principal yarns being at right angles to the stretch inhibitor so that there is less resistance to bending the integral fabric in the longitudinal direction. In the forward bending test the improved handrail exhibits over 40% less lip distortion than the convention handrail.

Lip strength measurements were also made on these handrails and the data are listed in Table 3 for comparison. These data show that there is consistent strength along the handrails and that there is a significant difference in lip strength with the subject handrail structure exhibiting about 30% greater lip strength, i.e., 107.3 newtons compared to 83.3 newtons average lip strength for the conventional handrail.

TABLE 2

STATIC CIRCULAR BENDING TEST OF HANDRAIL

| | Conventional | Subject Structure |
|---|---|---|
| **FORWARD BENDING TEST** | | |
| Effective length, mm | 800 | 800 |
| Original Lip Dimension, mm | 36.16 | 38.56 |
| Lip Dimension with Load, mm | 37.36 | 39.25 |
| Difference in Dimensions, mm | +1.18 | +0.69 |
| Force to Seat Handrail, gms | 2878 | 1600 |
| **BACKWARD BENDING TEST** | | |
| Effective length, mm | 800 | 800 |
| Original Lip Dimension, mm | 35.98 | 38.50 |
| Lip Dimension with Load, mm | 34.75 | 37.13 |
| Difference in Dimensions, mm | −1.23 | −1.37 |
| Force to Seat Handrail, gms | 3127 | 2266 |

TABLE 3

COMPARISON OF LIP STRENGTH OF HANDRAILS

| | | |
|---|---|---|
| **CONVENTIONAL HANDRAIL** | | |
| Lip strength measured at eight points, in Newtons | | |
| 1) 83.5 | 5) 81.8 | |
| 2) 76.9 | 6) 86.9 | |
| 3) 90.3 | 7) 91.3 | |
| 4) 80.5 | 8) 74.8 | |
| Average lip strength = 83.3 Newtons | | |
| **SUBJECT HANDRAIL STRUCTURE** | | |
| Lip strength measured at nine points, in Newtons | | |
| 1) 103.4 | 5) 104.4 | 9) 109.4 |
| 2) 109.6 | 6) 105.9 | |
| 3) 108.6 | 7) 110.1 | |
| 4) 107.7 | 8) 108.6 | |
| Average lip strength = 107.3 Newtons | | |

EXAMPLE 2

Dynamic Testing of Handrails

In order to demonstrate the utility of the invention a special integral handrail was constructed that contains both a section of a conventional handrail construction and a section of the subject handrail construction of this invention in the same endless handrail. More specifically, the handrail incorporated a 3 meter length of the common commercial handrail construction and a 3 meter section of a similar handrail size but incorporating the subject structure made from two rubber calendered glass fibre fabric plies separated by a rubber ply compounded to the formula of Table 1.

This composite handrail was subjected to an accelerated performance evaluation on a factory test rig. This test rig is of a similar design to that developed by the Otis Elevator Company, which can predict the expected lifetime performance of a handrail in 44 days run time, when run at 183 meters per minute or in 20 days time when run at 305 meters per minute.

The composite handrail was run for over 2000 hours (83 days) at the higher speed during which time both the lip strength and lip dimensions were measured on a periodic basis.

Figure 3:
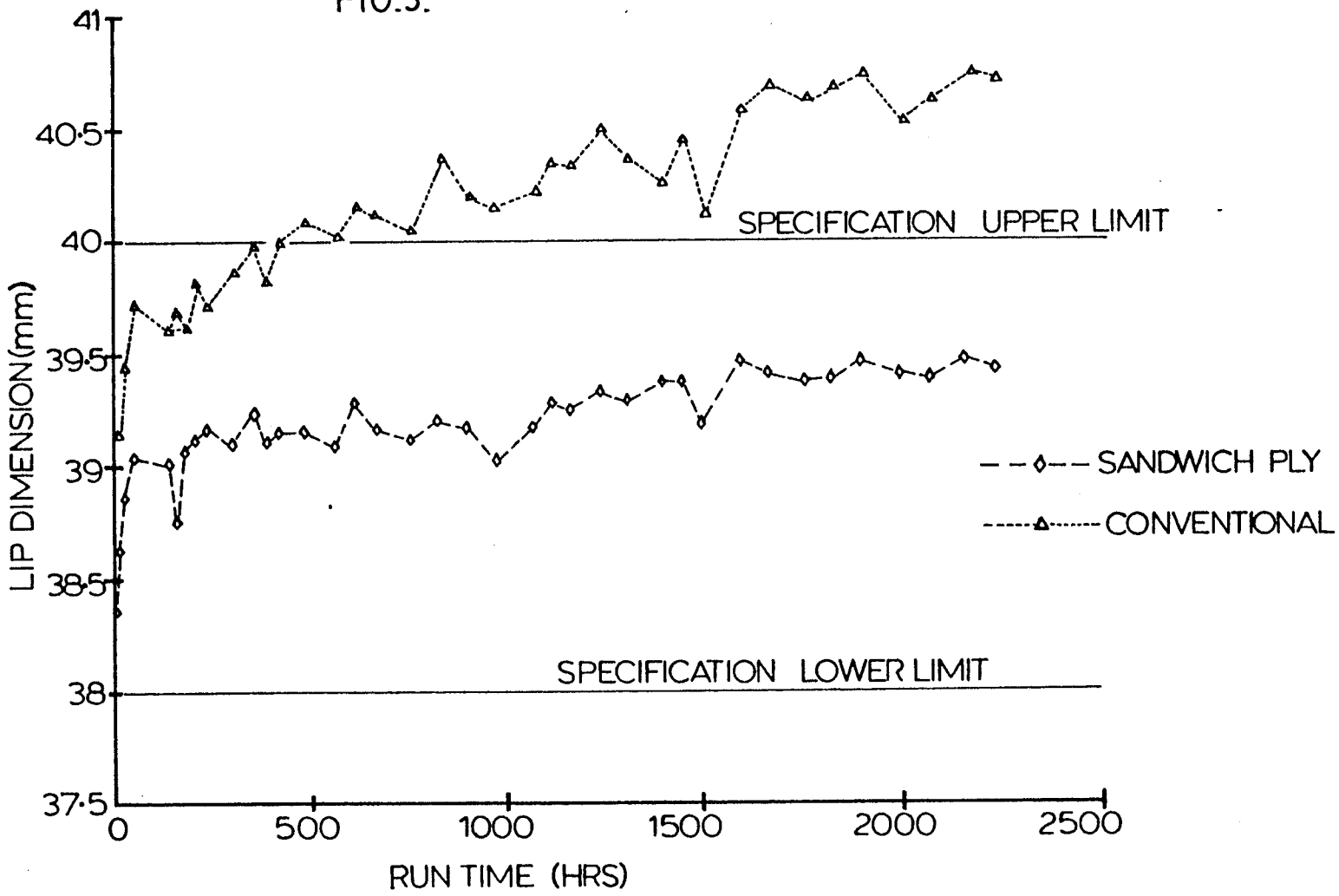
FIG. 3 is a graph showing the lip dimension as a function of run time for both the industry standard and the handrail of this invention.

FIG. 3 showns lip dimension as a function of run time. The lower plot shows that the subject structure has a lower initial change in lip dimension and slower growth in lip dimension over the longer time period than the conventional handrail product. Also, the handrail made with the subject construction remains within the industry specification throughout the test duration.

Figure 4:
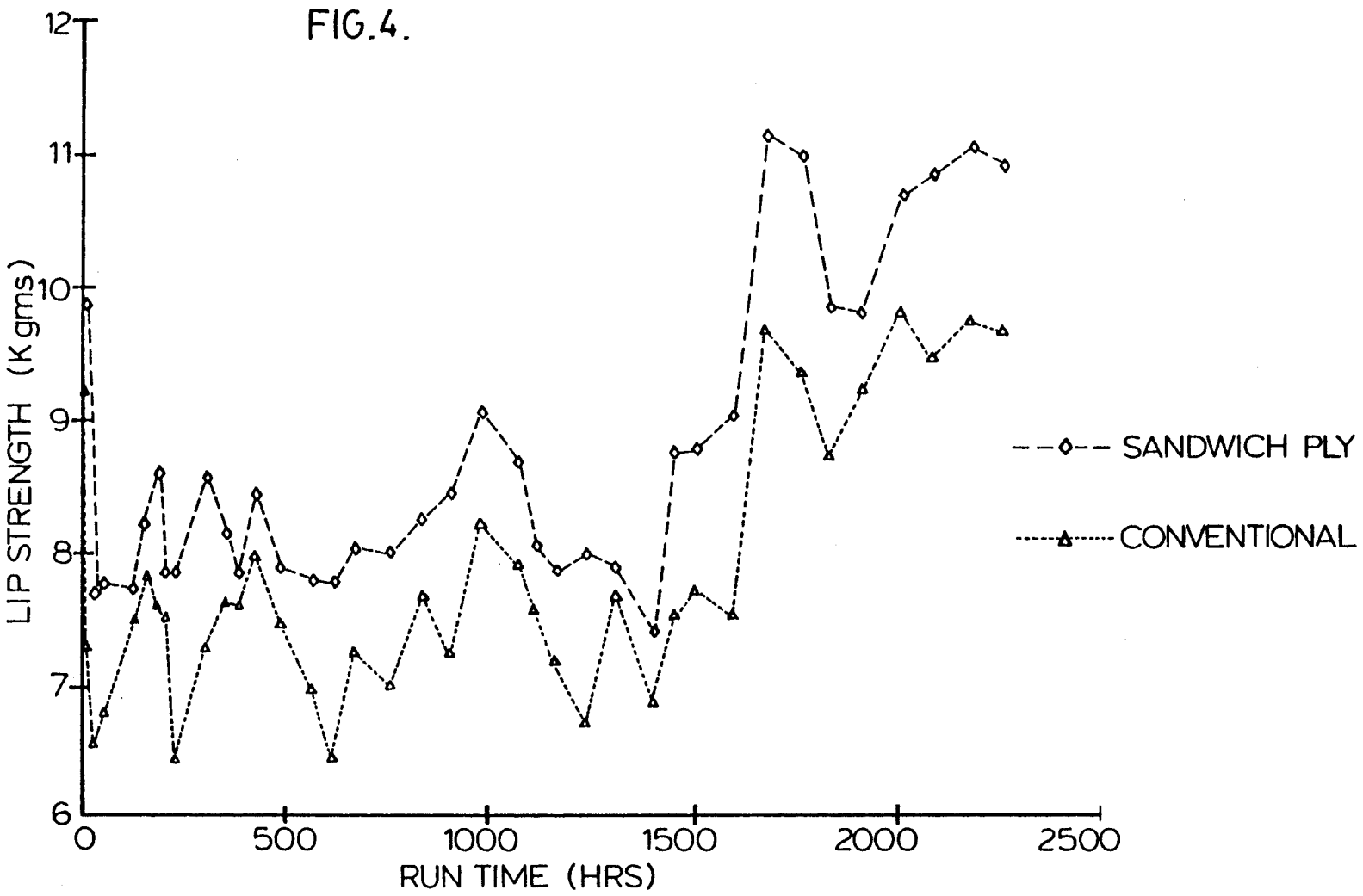
FIG. 4 is a graph showing lip strength as a function of run time for both the industry standard and the handrail of this invention.

In FIG. 4, lip strength is plotted as a function of test time. The initial lip strength values are somewhat higher than those after the test commences. This is due in part to the fact that the handrail heats up on running and is therefore softer, and to the general softening effect (Mullin's Effect) of the initial strain. The lip strength for the subject structure handrail remains consistently higher than that for the conventional handrail throughout the test. There is a tendency for the lip strength to increase after a long run time. This is due in part to the hardening of the rubber compound by the formation of additional crosslinks in the rubber matrix.

Although preferred embodiments of the invention are described herein in detail, it will be understood by those skilled in the art that variations may be made thereto without departing from the spirit of the invention or the scope of the appended claims.

We claim:

1. In an improved handrail construction adapted for use on escalators, moving walkways and the like, the improved handrail exhibiting increased lateral stiffness, dimensional stability and greater lip strength properties and having:

i) a C-shaped cross-section with a transverse portion and opposing inwardly directed lip portions, said opposing lip portions locating said handrail for use on escalators and moving walkways, ii) a stretch inhibitor extending longitudinally of said handrail and through said transverse portion, iii) multiple plies of reinforcing fabric being located in said transverse portion, iv) said stretch inhibitor and multiple plies being molded in a first rubber composition to provide said C-shape cross-section, v) a slider member being provided on the underside of said handrail, the improvement which provides said increased lateral stiffness, dimensional stability and greater lip strength properties, comprising:

vi) two spaced apart plies of reinforcing woven fabric having stiff principal yarns which extend perpendicular to said stretch inhibitor and across said transverse portion and around said opposing lip portions to adjacent inner extremities of said opposing lip portions, vii) said two spaced apart plies being interconnected by a second rubber composition which has a higher strength in terms of stiffness, hardness and viscosity than said first rubber composition, viii) said two spaced apart plies with said transversely extending principal yarns and said interconnecting second rubber composition forming a structural sandwich construction which provides said increased properties, ix) said sandwich construction being molded within said first rubber composition to complete said improved handrail construction.

2. In an improved handrail construction of claim 1, said stretch inhibitor being positioned adjacent said sandwich construction.

3. In an improved handrail construction of claim 1, said stretch inhibitor being positioned within said sandwich structure between said two spaced apart plies.

4. In an improved handrail construction of claim 1, said principal yarns being selected from the group consisting of stiff cotton yarns and spun synthetic fibre.

5. In an improved handrail construction of claim 1, said principal yarns being monofilaments selected from the group consisting of glass monofilaments and polyaramid monofilaments.

6. In an improved handrail construction of claim 1, said principal yarns being a bundle of twisted continuous filament of glass or polyaramid.

7. In an improved handrail construction of claim 1, said two plies are spaced apart from one another a consistent distance across said C-shaped cross-section.

8. In an improved handrail construction of claim 1, each of said two plies is a woven fabric having said principal yarns of glass monofilament.

9. In an improved handrail construction of claim 1, said second rubber composition having a cured strength of at least 10% greater than the cured strength of said first rubber composition.

10. In an improved handrail construction of claim 9, said second rubber composition has increased strength by use of rubber compatible clay and carbon black of a fine particle size.

11. In an improved handrail construction of claim 1, said two spaced apart plies being the only reinforcing plies in said improved handrail construction.

12. In an improved handrail construction of claim 11, said plies having principal yarns of glass monofilaments.

13. In an improved handrail construction of claim 1, said stretch inhibitor comprising a plurality of longitudinally extending wire cables positioned between said plies, said plies being spaced apart a greater distance in said transverse portion than in said opposing lip portion by a distance equal to said wire cable diameter.

14. In an improved handrail construction of claim 3, said stretch inhibitor comprising a plurality of longitudinally extending wire cables which are all located in the same transverse plane and each have a diameter in the range of 0.5 mm to 2 mm, said two plies being spaced apart by a consistent distance across said C-shaped section selected from the range of 1 mm to 3 mm.

* * * * *